United States Patent [19]

Blanchard

[11] 4,040,378

[45] Aug. 9, 1977

[54] METHOD AND APPARATUS FOR INSTALLING A MARINE PROPULSION DEVICE

[75] Inventor: Clarence E. Blanchard, Kenosha, Wis.

[73] Assignee: Outboard Marine Corporation, Waukegan, Ill.

[21] Appl. No.: 632,268

[22] Filed: Nov. 17, 1975

Related U.S. Application Data

[63] Continuation-in-part of Ser. No. 482,468, June 24, 1974, Pat. No. 3,968,767.

[51] Int. Cl.[2] ..... B63H 21/30

[52] U.S. Cl. ..... 115/74; 115/34 R

[58] Field of Search ..... 115/34 R, 35, .5 S, 115/70, 25; 9/600, 8 P; 16/2; 277/178; 248/56, 4; 285/192, 193

[56] References Cited

U.S. PATENT DOCUMENTS

| | | | |
|---|---|---|---|
| 1,473,049 | 11/1923 | Roberts | 115/25 |
| 1,774,956 | 9/1930 | Wilson | 115/35 |
| 2,633,817 | 4/1953 | Pedranti | 115/35 X |
| 2,748,743 | 6/1956 | Shogran | 248/4 X |
| 3,094,967 | 6/1963 | Willis, Jr. | 115/35 |
| 3,372,408 | 3/1968 | Luger et al. | 9/6 W |
| 3,590,407 | 7/1971 | Bratianu | 9/8 P |

*Primary Examiner*—Trygve M. Blix
*Assistant Examiner*—Sherman D. Basinger
*Attorney, Agent, or Firm*—Michael, Best & Friedrich

[57] ABSTRACT

Disclosed herein is a marine propulsion installation comprising a boat hull including a bottom surface having therein an aperture, a mounting collar having a lower portion which extends through the aperture and which includes an upper end and a flange extending generally horizontally outwardly from the upper end of the lower portion, a seal sealing the boat hull bottom to the lower portion of the collar, a rigidifying structure extending between the boat hull bottom and the flange of the collar, a mounting bracket having a first portion fixed to the flange and an inner portion, an endless mount of resilient material including an outer surface having therein a recess receiving the inner portion of the mounting bracket, which mount also includes upper and lower surfaces spaced respectively above and below the recess and, a marine propulsion device including an adaptor including a lower end having a downwardly facing surface engaging the upper surface of the mount, and a lower unit including a lower portion extending through the aperture and rotatively supporting an element adapted for propelling the hull through the water, and an upper portion fixed to the lower end of the adaptor and including an upwardly facing surface engaging the lower surface of the mount.

13 Claims, 3 Drawing Figures

Fig. 1
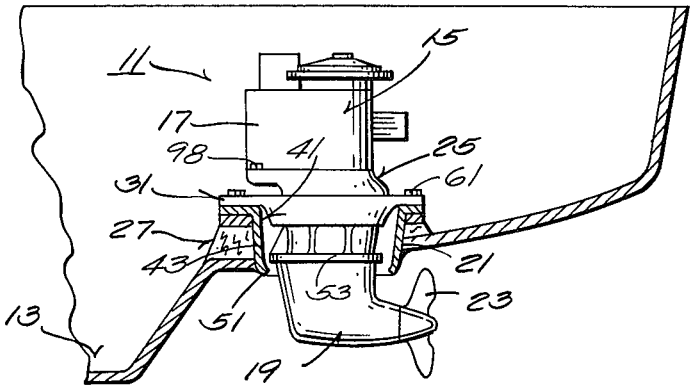
Fig. 3
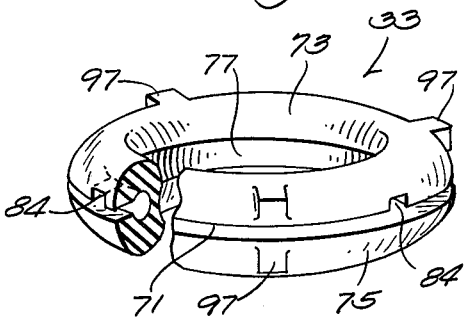
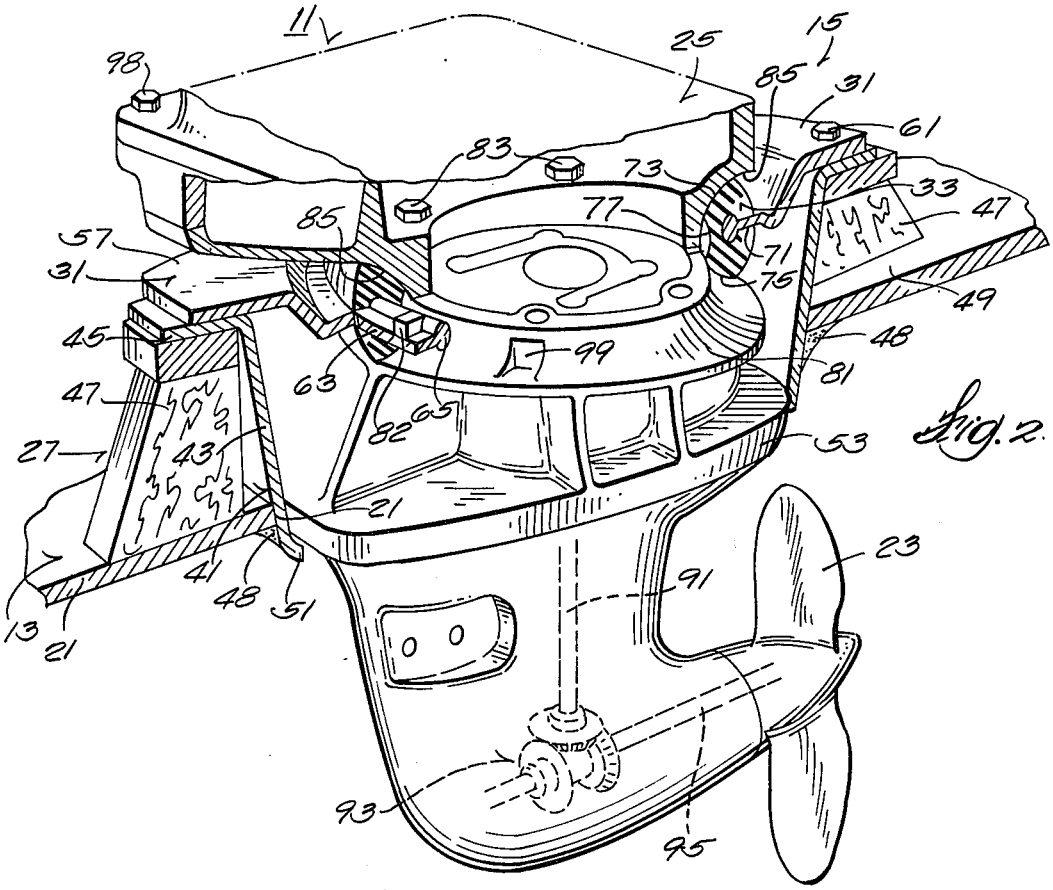
Fig. 2

METHOD AND APPARATUS FOR INSTALLING A MARINE PROPULSION DEVICE

RELATED APPLICATION

This application is a continuation-in-part of my earlier application Ser. No. 482,468 filed June 24, 1974, now, U.S. Pat. No. 3,968,767 granted July 13, 1976, and is related to my application Ser. No. 632,267 filed Nov. 17, 1975, now U.S. Pat. No. 3,982,496 granted Sept. 28, 1976.

BACKGROUND OF THE INVENTION

The invention relates generally to the mounting of marine propulsion devices in boat hulls.

More particularly, the invention relates to the mounting of marine propulsion devices which extend through the bottom of a hull of a boat, such as a sailboat.

Attention is directed to U.S. Pat. No. 3,190,254 issued June 22, 1965.

SUMMARY OF THE INVENTION

The invention provides a boat hull including a bottom surface having therein an aperture, a mounting collar having a lower portion which extends through the aperture and which includes an upper end and a flange extending generally horizontally outwardly from the upper end of the lower portion, means sealing the boat hull bottom to the lower portion of the collar, and rigidifying means extending between the boat hull bottom and the flange of the collar.

The invention also provides a marine propulsion installation comprising a boat hull including a bottom having therein an aperture, and a support located in the boat hull above the boat and adjacent the aperture, a mounting bracket having a portion fixed to the support, an endless mount of resilient material carried by the mounting bracket and including upper and lower surfaces, and a marine propulsion device including an adaptor including a lower end having a downwardly facing surface engaging the upper surface of the mount, and a lower unit including a lower portion extending through the aperture and rotatively supporting an element adapted for propelling the hull through the water, and an upper portion fixed to the lower end of the adaptor and including an upwardly facing surface engaging the lower surface of the mount.

In one embodiment, there is provided a marine propulsion installation comprising a boat hull including a bottom surface having therein an aperture, a mounting collar having a lower portion which extends through the aperture and which includes an upper end and a flange extending generally horizontally outwardly from the upper end of the lower portion, means sealing the boat hull bottom to the lower portion of the collar, rigidifying means extending between the boat hull bottom and the flange of the collar, a mounting bracket having a first portion fixed to the flange and a second portion, an endless mount of resilient material including an outer surface having therein a recess receiving the second portion of the mounting bracket, and a marine propulsion device including an adaptor including a lower end having a downwardly facing surface engaging an upper surface of the mount, and a lower unit including a lower portion extending through the aperture and rotatively supporting an element adapted for propelling the hull through the water and an upper portion fixed to the lower end of the adaptor and including an upwardly facing surface engaging a lower surface of the mount.

The invention also provides a method of providing a support for a marine propulsion device extending through the bottom of a boat hull, which method comprises the steps of forming an aperture in the bottom of the boat hull, inserting in the aperture a collar having a lower tubular portion extending through the aperture and having an upper flange portion extending outwardly from the tubular portion, rigidly fixing the flange portion to the boat hull, and sealing the lower portion of the collar to the boat hull to prevent entry of water into the boat hull between the boat hull bottom and the lower portion of the collar.

The invention also provides a method of installing a marine propulsion device including an adaptor and a lower unit into a boat hull, which method comprises the steps of forming a support in the boat hull around an opening in the bottom of the boat hull, fixing a mounting plate on the support with an annular resilient mounting member located on the plate inwardly of the support, resting the adaptor of the marine propulsion device on the resilient annular member, and fixedly assembling the lower unit of the marine propulsion device to the adaptor with the annular mounting member being captured between the adaptor and the lower unit to thereby support and vibrationally isolate the adaptor and lower unit from the plate and to prevent entry of water into the boat hull between the plate and the assembly of the adaptor and lower unit.

In one embodiment of the invention, there is provided a method of installing a marine propulsion device including an adaptor and a lower unit into a boat hull, which method comprises the steps of forming an aperture in the bottom of the boat hull, inserting in the aperture a collar having a lower tubular portion extending through the aperture and having an upper flange extending outwardly from the tubular portion, rigidly fixing the flange to the boat hull, sealing the lower end of the tubular portion to the boat hull to prevent entry of water into the boat hull between the boat hull bottom and the lower end of the tubular portion, fixing a mounting ring on the flange with an annular resilient mounting member located on the ring inwardly of the flange, resting the adaptor of the marine propulsion device on the resilient annular member, and fixedly assembling the lower unit of the marine propulsion device to the adaptor with the mounting member being captured between the adaptor and the lower unit to thereby support and vibrationally isolate the adaptor and lower unit from the ring and to prevent entry of water into the boat hull between the ring and assembly of the adaptor and lower unit.

One of the principal features of the invention is the provision of a method of fabricating a support for mounting a marine propulsion device which extends through the bottom of a boat hull, such as a sailboat.

Another of the principal features of the invention is the provision of a method for installing a marine propulsion device in a boat hull, such as a sailboat, with the device projecting through a hole in the bottom of the boat hull.

Another of the principal features of the invention is the provision of a boat hull including a support which is particularly adapted for mounting a marine propulsion device extending through the bottom of the boat hull.

Still another of the principal features of the invention is the provision of a mounting arrangement for a marine propulsion device extending through an opening in the bottom of a boat hull, which arrangement serves to support and vibrationally isolate the marine propulsion device from the boat hull and to provide seals preventing entry of water into the boat hull through the mounting arrangement.

Still another of the principal features of the invention is the provision of a mounting arrangement as referred to in the preceding paragraph, which arrangement includes an integrally constructed resilient member which cooperates with other parts to provide the supporting, vibration isolating, and sealing functions.

Still another of the principal features of the invention is the provision of a boat including a marine propulsion device which extends through an opening in the boat bottom and which is supported by a resilient member which additionally serves to vibrationally isolate the boat hull from the marine propulsion device, while at the same time, providing a watertight seal against the entry of water into the boat hull through the mounting arrangement.

Still another of the principal features of the invention is the provision of a marine propulsion installation which is relatively easy to construct and assemble.

Other features and advantages of the embodiments of the invention will become known by reference to the following drawings, general description and appended claims.

THE DRAWINGS

FIG. 1 is a fragmentary sectional view through a boat hull forming a part of a marine propulsion installation including various of the features of the invention.

FIG. 2 is enlarged, partially broken away, and fragmentary perspective view of the marine propulsion installation shown in FIG. 1.

FIG. 3 is a partially broken away and cross sectional perspective view of one of the components of the installation shown in FIGS. 1 and 2.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device 11 installed in the hull 13 of a boat, such as a sailboat. The marine propulsion device 11 generally comprises a propulsion unit 15 including a power head 17 of any conventional construction, together with a lower unit 19 which extends through an aperture in the boat hull bottom 21 and rotatably supports an element or propeller 23 adapted to propel the boat through the water, and an upper part or adaptor 25 which is fixed to and between the lower unit 19 and the power head 17. In addition, there is provided, in the boat hull 13, a support or pedestal 27 which is integrated into the boat hull 13 and which surrounds the aperture in the bottom 21 of the boat hull 13. In turn, the support 27 fixedly supports a mounting plate or bracket or member 31 which cooperates with an annular mounting ring 33 which engages the propulsion unit 17 to support and to vibrationally isolate the propulsion unit 15 from the boat hull 13, and to provide a seal preventing entry of water into the boat hull 13.

The support or pedestal 27 can be formed either as a part of the boat hull 13 during initial fabrication thereof or can be constructed in an existing boat hull. While the foregoing disclosure is directed to installation of the support in an existing boat hull, it is obvious that the disclosure can be readily employed to provide the support 27 when the boat hull 13 is initially fabricated.

When incorporating the support or pedestal 27 in the boat hull 13 which can, for example, be fabricated of fiberglass, the bottom 21 of the boat hull is first apertured in any suitable way, thereby temporarily destroying the water-tight integrity of the hull, to ultimately permit passage therethrough of the lower end of the propulsion unit 17. Thereafter, a mounting collar 41 having a lower portion 43 is inserted through the aperture. The lower portion 43 of the collar 41 is generally tubular in shape and can be cylindrical or oval or generally rectangular in shape. The mounting collar 41 also includes an upper mounting flange 45 which extends outwardly from the upper end of the tubular lower portion 43 above the boat bottom 21. The flange 45 is then temporarily supported so as to be located generally horizontally when the hull 13 is stationary in the water. When thus in position, rigidifying, reinforcing, or support members 47 are formed to fit between the flange 45 of the collar 41 and the inside surface of the bottom 21 of the boat hull 13 so as to fixedly support the flange 45 from the boat hull 13. Preferably, the collar 41 is fabricated of fiberglass or other similar plastic. If desired, the flange can be reinforced by a washer of wood or other suitable material (not shown).

Any suitable number of rigidifying members 47 can be located in circumferentially spaced relation around the tubular lower portion 43 of the collar 41. The rigidifying members 41 can be formed of plywood or of any other suitable material.

The assembly of the boat hull 13, mounting collar 41 and rigidifying or supporting members 47 is then integrated into a single unity, preferably by being bonded together by fiberglass applied to the flange 45 of the collar 41, and the members 47 and to the boat hull 13. While the pedestal or support 27 can be constructed in a cylindrical shape it is preferred to form the support 27 with a series of circumferentially spaced recesses or cavities 49 which are located between the members 47 and which are adapted to receive bolts or associated nuts for assembling the mounting bracket 31 to the top of the support 27.

In order to prevent entry of water into the boat hull 13 between the boat bottom 21 and the lower portion 43 of the collar 41, and thereby to restore the water-tight integrity of the hull, and also to assist in strengthening the support 27, fiberglass or other suitable material 48 is bonded to and between the margin of the aperture in the boat bottom 21 and the lower end of the collar 41.

The bottom end of the tubular lower portion 43 of the collar 41 can be cut off to conform to the shape of the boat hull bottom 21. Preferably, however, and in order to provide for smooth flow of water past the lower unit 19 in the area adjacent to the bottom 21 of the boat hull 13, the bottom end of the collar 21 is formed to include an inturned flange 51 which, in the completed installation, extends inwardly of and slightly below a flange part 53 on the lower unit 19. In addition, fiberglass or other suitable material 48 can be built-up between the hull 13 and the bottom end of the tubular lower portion 43 of the collar 41 to provide a more or less continuously smooth surface between the bottom end of the collar 41 and the bottom 21 of the boat hull 13. The tubular lower portion 43 of the collar 41 is provided with sufficient vertical height so as to permit installation in boat hulls having stern portions extending at various angles.

The mounting plate or bracket 31 is preferably fabricated of metal and includes a radially outer ring portion 57 which rests on the top of the support 27. A plurality of spaced bolt and nut connections 61 extend through the outer ring portion 57 and through the flange 45 to fixedly connect the bracket 31 to the support 27. As already indicated, the lower ends of the nut and bolt connections 61 extend into the recessed areas or cavities 49 between the reinforcing members 47. Any suitable means can be employed to assure watertight connection between the mounting bracket 31 and the boat hull 13.

The mounting bracket 31 also includes an inner portion 63 preferably having a generally continuously extending enlarged bead 65. The inner and outer portions 63 and 57, respectively, of the mounting bracket 31 can be coplanar or can be offset and, in the illustrated construction, the inner ring portion 63 is offset below the outer portion 57 of the bracket 31.

The annular mounting ring 33 is fabricated of rubber or other suitable material providing vibration isolation and water sealing capabilities. More specifically, the annular mounting ring 33 includes an outer peripheral recess 71 enlarged at the radially inner end thereof so as to receive the inner portion 63 of the bracket 31 and the enlarged bead 65 in tight engagement and thereby to provide a watertight seal. The annular mounting ring 33 also includes upper and lower surfaces 73 and 75 located respectively above and below the peripheral recess 71 and an inner slightly concave surface 77. While the disclosed annular mounting ring 33 is generally of endless construction, the ring 33 can be of split construction.

The upper end of the lower unit 19 is formed with an upwardly facing surface 81 which, when the installation is complete, engages the lower surface 75 of the annular mounting ring 33. In the illustrated construction, the upwardly facing surface 81 is upwardly and outwardly concave in shape.

The lower end of the adapter 25 as already indicated, is fixed to the upper end of the lower unit 19 by suitable means such as a plurality nut and bolt connections 83 and includes a downwardly facing surface 85 which, when the installation is complete, engages the upper surface 73 of the mounting ring 33. When fully assembled, the annular mounting ring 33 is somewhat squeezed between the upwardly and downwardly facing surfaces 81 and 85 to insure a watertight seal between the propulsion unit 15 and the mounting ring 33 and between the mounting ring 33 and the inner portion 63 of the mounting bracket 33. However, such squeezing does not substantially adversely impair the ability of the mounting ring 33 to vibrationally isolate the propulsion unit 15 while at the same time supporting the propulsion unit 15 from the mounting bracket 31.

Extending through the adaptor 25 into the lower unit 19 is a drive shaft 91 which is driven by the power head 17 and which is connected through suitable gearing 93 within the lower unit 19 to a propeller shaft 95 carrying the propelling element or propeller 23.

Means are provided for preventing relative rotation between propulsion unit 15 and the mounting bracket 31. Thus, means are provided on the mounting ring 33 and on at least one of the upper end of the lower unit 19 and the lower end of the adaptor 25 for preventing relative rotation between the propulsion unit 15 and the mounting ring 33. In the illustrated construction, the annular mounting ring 33 includes a plurality of angularly spaced lugs or projections 97 which are received into mating recesses 99 in the upper and lower surfaces 81 and 85 respectively of the lower unit 19 and adaptor 25. If desired, the surfaces 81 and 85 could be provided with lugs and the mounting ring could be provided with recesses. In addition, suitable means, such as interfitting lugs 82 and cavities 84 are provided on the mounting ring 33 and on the mounting bracket 31 to prevent relative rotation therebetween. Thus, the lower unit 19 is fixed relative to the boat hull 13, and a separate rudder (not shown) is employed to provide steering control.

During installation of the propulsion unit 15 in the boat hull 13, the mounting bracket 31 is bolted or otherwise suitably attached to the surface 27 either before or after the annular mounting ring 33 is manipulated to engage the bead 65 and inner portion 63 thereof in the recess 71 of the annular mounting ring 33. Thereafter, the adapter 25 is rested on the mounting ring 33 and the lower unit 19 is temporarily supported below the mounting ring 33 to permit assembly therebetween by the nut and bolt connections 83 so as to capture the mount between the upper and lower surfaces 81 and 85 of the lower unit 19 and of the adapter 25 respectively. Employment of the mounting ring 33 with the inner concave surface 77 reduces any possibility of entrapping a part of the annular resilient mounting ring 33 between the mating surfaces of the adaptor 25 and the lower unit 19 when tightening the nut and bolt connections 83.

If desired the annular mounting ring 33 can include an inwardly extending gasket or sealing part (not shown) adapted to extend between the mating surfaces of the adaptor 25 and lower unit 19.

After the adaptor 25 and lower unit 19 are assembled as just explained, the power head 17 is then connected to the adaptor 25 by any suitable means such as a plurality of nut and bolt connections 98.

Apart from the downwardly facing surface 85 on the adaptor 25 and the upwardly facing surface 81 on the lower unit 19, any suitable construction can be employed, as for instance, the construction disclosed in my earlier application Ser. No. 482,468, filed June 24, 1974. There is thus provided both a desirable support for a marine propulsion installation and a complete marine propulsion installation through the bottom of a boat hull, together with methods for providing both the support and the overall installation.

Various of the features of the invention are set forth in the following claims.

What is claimed is:

1. A boat hull including a bottom having thickness, said bottom having therein an aperture with a length through said bottom substantially equal to said thickness, a mounting collar having a sleeve portion which has a length substantially greater than the thickness of said boat hull bottom, which extends through said aperture, and which includes an upper end having a flange extending generally horizontally outwardly from said sleeve portion and in spaced relation above said boat hull bottom, means sealing said boat hull bottom to said sleeve portion of said collar, and rigidifying means extending between said boat hull bottom and said flange of said collar and comprising a circular series of angularly spaced, vertically extending members.

2. A boat hull including a bottom surface having therein an aperture, a mounting collar having a sleeve portion which extends through said aperture and which includes an upper end having a flange extending generally horizontally outwardly from said sleeve portion, a mounting bracket having a first portion fixed to said flange and a second portion, means sealing said boat hull bottom to said sleeve portion of said collar, rigidifying means extending between said boat hull bottom and said flange of said collar, an endless mount of resilient material including an outer surface having therein a recess receiving said second portion of said mounting bracket, said mount also including upper and lower surfaces spaced respectively above and below said recess and, a marine propulsion device including an upper part including a lower end having a downwardly facing surface engaging said upper surface of said mount, and a lower unit including a lower portion extending through said aperture and rotatively supporting an element adapted for propelling said hull through the water and an upper portion fixed to said lower end of said upper part and including an upwardly facing surface engaging said lower surface of said mount.

3. A boat hull in accordance with claim 1 wherein said collar further includes a lower flange which extends inwardly from the lower end of said sleeve portion.

4. A boat hull in accordance with claim 1 wherein said sealing means comprises a plastic material.

5. A marine propulsion installation comprising a boat hull including a bottom having therein an aperture, and a support located in said boat hull above said bottom and adjacent to said aperture, a mounting bracket having a portion fixed to said support, an endless mount of resilient material carried by said mounting bracket and including upper and lower surfaces, and a marine propulsion device including an adaptor including a lower end having a downwardly facing surface engaging said upper surface of said mount, and a lower unit including a lower portion extending through said aperture and rotatively supporting an element adapted for propelling said hull through the water and an upper portion fixed to said lower end of said adaptor and including an upwardly facing surface engaging said lower surface of said mount.

6. A marine propulsion installation in accordance with claim 5 wherein said mount includes an outer surface located between said upper and lower surfaces and including a recess receiving said mounting bracket.

7. An installation in accordance with claim 5 and further including means on said mount and on at least one of said adaptor and said lower unit for preventing rotation of said propulsion device relative to said boat hull.

8. A method of providing a support for a marine propulsion device located in a boat hull and extending through the boat hull bottom, said method comprising the steps of providing a boat hull having water-tight integrity, forming in the boat hull bottom an aperture, inserting in the aperture a collar including a lower tubular portion extending through the aperture and having an upper flange portion extending outwardly from the tubular portion in spaced relation above the boat hull bottom, rigidly fixing the flange portion to the boat hull, mounting a marine propulsion device on the collar with a portion thereof extending through the collar tubular portion to below the boat hull, and sealing the collar to the boat hull and the marine propulsion device to the collar to provide water-tight integrity between the boat hull and the collar and between the collar and the propulsion device and thereby restore water-tight integrity to the boat hull.

9. A method of providing a support for a marine propulsion device extending through the bottom of a boat hull, said method comprising the steps of forming an aperture in the bottom of the boat hull, inserting in the aperture a collar having a lower tubular portion extending through the aperture and having an upper flange portion extending outwardly from the tubular portion, rigidly fixing the flange portion to the boat hull, sealing the lower portion of the collar to the boat hull to prevent entry of water into the boat hull between the boat hull bottom and the lower portion of the collar, fixing a mounting ring on the flange portion with an annular resilient mounting member located on the ring inwardly of the flange portion, resting a part of the marine propulsion device on the resilient annular member, and fixedly assembling a lower unit of the marine propulsion device to the part with the mounting member being captured between the part and the lower unit to thereby support and vibrationally isolate the part and lower unit from the ring and to prevent entry of water into the boat hull between the ring and the assembly of the part and lower unit.

10. A method of installing a marine propulsion device including an adaptor and a lower unit into a boat hull, which method comprises the steps of forming a support in the boat hull around an opening in the bottom of the boat hull, fixing a mounting plate on the support with an annular resilient mounting member located on the plate inwardly of the support, resting the adaptor of the marine propulsion device on the resilient annular member, and fixedly assembling the lower unit of the marine propulsion device to the adaptor with the annular mounting member being captured between the adaptor and the lower unit to thereby support and vibrationally isolate the adaptor and lower unit from the plate and to prevent entry of water into the boat hull between the plate and the assembly of the adaptor and lower unit.

11. A method of installing a marine propulsion device including an upper part and a lower unit into a boat hull, which method comprises the steps of forming a support member in the boat hull around an opening in the bottom of the boat hull, locating an annular resilient mount member on the support member, resting the upper part of the marine propulsion device on the resilient annular member, and fixedly assembling the lower unit of the marine propulsion device to the upper part with the annular mounting member being captured between the upper part and the lower unit to thereby support and vibrationally isolate the upper part and lower unit from the support member and to prevent entry of water into the boat hull between the support member and the assembly of the upper part and lower unit.

12. A marine propulsion installation comprising a boat hull including a bottom having therein an aperture, and a member fixed in said boat hull above said bottom and adjacent to said aperture, an endless mount of resilient material carried by said member and including upper and lower surfaces, and a marine propulsion device including an upper part including a lower end having a downwardly facing surface engaging said upper surface of said mount, and a lower unit including a lower portion extending through said aperture and rotatively supporting an element adapted for propelling said hull through the water and an upper portion fixed to said lower end of said upper part and including an upwardly facing surface engaging said lower surface of said mount.

13. An installation in accordance with claim 12 and further including means on said mount and on at least one of said member and said lower unit for preventing rotation of said propulsion device relative to said boat hull.

* * * * *